United States Patent [19]

Hastings

[11] 4,294,348

[45] Oct. 13, 1981

[54] CARRYING CASE FOR ARTIST'S MATERIALS

[76] Inventor: Jeanne D. Hastings, Old Stone School House, Middle Rd., Lake George, N.Y. 12845

[21] Appl. No.: 133,529

[22] Filed: Mar. 24, 1980

[51] Int. Cl.[3] ..... B65D 71/00; A45C 13/18

[52] U.S. Cl. ..... 206/1.7; 206/575; 206/373; 312/333; 312/DIG. 33

[58] Field of Search ..... 206/1.7, 575, 1.9, 1.5, 206/372, 373; 312/DIG. 33, 220, 333

[56] References Cited

U.S. PATENT DOCUMENTS

| | | | |
|---|---|---|---|
| 1,901,861 | 3/1933 | Baker | 206/1.9 |
| 2,683,642 | 7/1954 | Stoleson | 312/333 |
| 3,092,428 | 6/1963 | Kerschner | 206/373 |
| 3,259,230 | 7/1966 | Jaeger | 206/373 |
| 3,576,252 | 4/1971 | Conally | 206/1.7 |
| 3,966,103 | 6/1976 | Abrams | 206/449 |
| 4,016,973 | 4/1977 | Blake | 206/1.5 |
| 4,058,210 | 11/1977 | Mitchell | 312/DIG. 33 |

*Primary Examiner*—Herbert F. Ross
*Attorney, Agent, or Firm*—Gerhard K. Adam

[57] ABSTRACT

A paint box for organizing, storing and transporting artist's materials is disclosed. The paint box includes a lower storage section of drawers for storing a palette, brushes, drawing equipment and the like, an upper main storage section for paints, oils and solvents, and a device for maintaining the box in a closed position.

10 Claims, 4 Drawing Figures

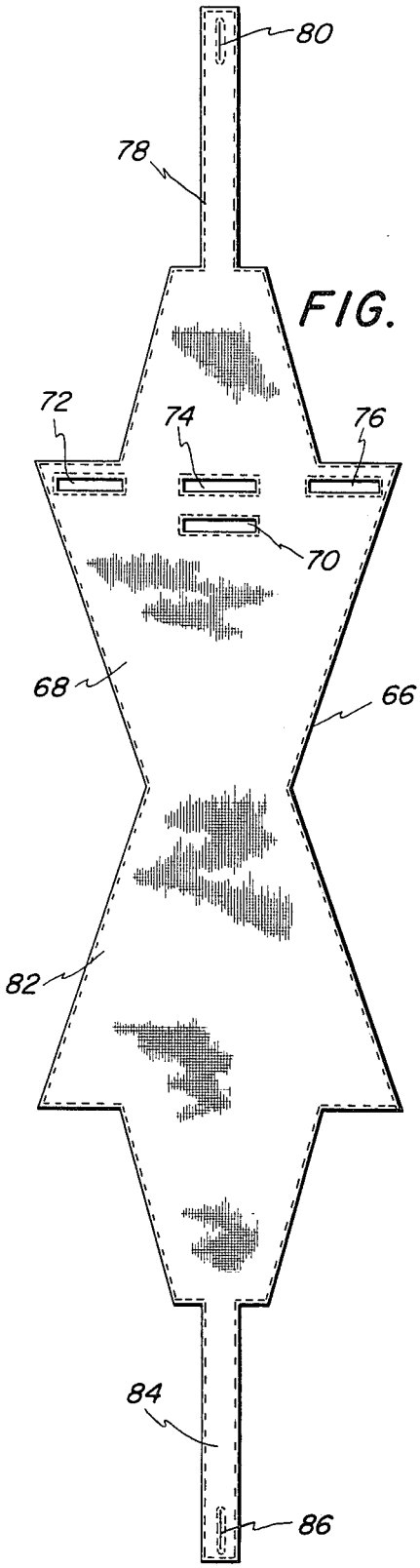
FIG. 3
FIG. 4
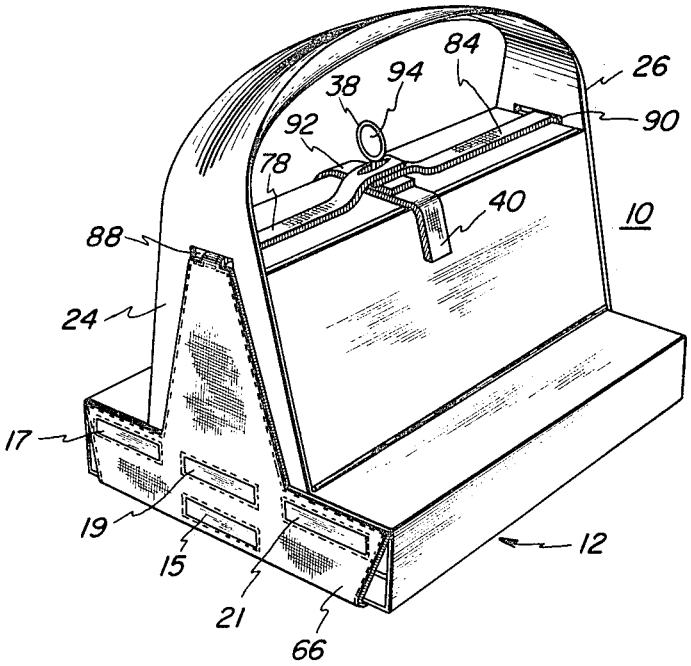

CARRYING CASE FOR ARTIST'S MATERIALS

BACKGROUND OF THE INVENTION

Customarily, paint boxes or cases are used to store and transport artist's materials. These boxes are available in different sizes and shapes to contain palettes, tubes of paint, brushes and various other artist's implements, such as paint brushes, palette knives, etc. When painting outdoors or on location, the artist must carry all his equipment with him and each item should be readily accessible for use.

It is therefore an object of the present invention to provide a novel and improved paint box for the storage and transportation of equipment required for artists, and especially oil painters, in such a manner that the artist's tools and paints are extremely well organized and readily accessible.

SUMMARY OF THE INVENTION

In accordance with the present invention, I have discovered an improved paint box for storing artist's materials in an organized manner and for transporting these materials. The paint box has a lower section or base containing a number of drawers for storing a palette, brushes, spatulas, drawing equipment and the like. Mounted on the lower section is an upper section or body portion of the box having a front end and a back end which are connected to the base and that converge and unite at the top of each end to form a handle. A top portion of the box connects the two ends below the handle. The rest of the body portion of the box is formed by two opposing sides which are located between the ends and are hinged to the base. When the sides are in raised position the box is closed and when the sides are in lowered position with the sides resting on the base, the box is open.

Preferrably there is also a securing means for maintaining the paint box closed and for keeping the drawers from falling out of the base while the box is being carried from place to place.

BRIEF DESCRIPTION OF THE DRAWING

The invention is more clearly understood from the following description taken in conjunction with the accompanying drawing in which:

FIG. 3 is a top view of a securing means for locking the drawers of the paint box.

FIG. 4 is a three dimensional view of the locked paint box with the securing means of FIG. 3 in place around the paint box of FIG. 1.

DETAILED DESCRIPTION OF THE INVENTION

Figure 1:
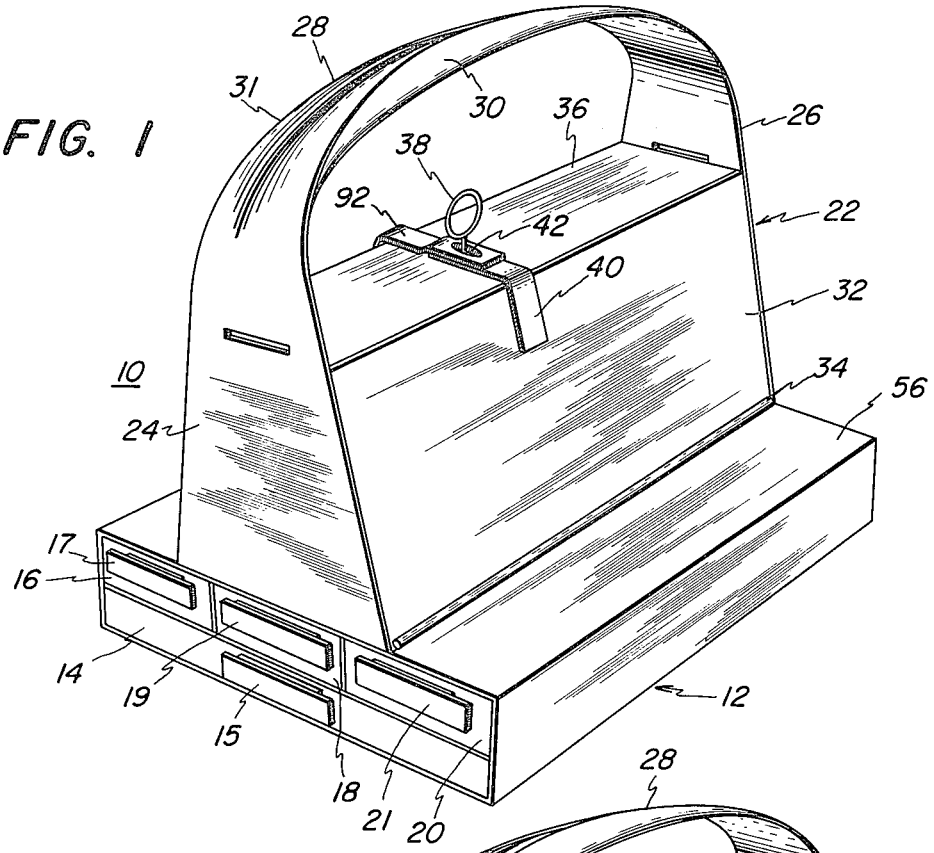
FIG. 1 is a three dimensional view of the closed paint box of the present invention.

Referring now to FIG. 1, the paint box 10, shown in the closed position, has a lower section or base 12 which is adapted to contain a plurality of drawers 14, 16, 18 and 20. The number and exact dimensions of the drawers are not critical and these may be modified as required. In the preferred embodiment as illustrated, the bottom drawer 14 extends the full width of the base 12 and provides a compartment for storing a palette. The compartment may be sealed with a gasket to prevent the paint from drying. Projecting handles 15, 17, 19 and 21 are attached to the outer end of each drawer 14, 16, 18 and 20 respectively. Mounted above base 12 is main body 22 having front end 24 (on the same side as drawers 14, 16, 18 and 20) and back end 26, which are substantially similar in shape. The ends 24 and 26 converge at their top portions in an arch-like fashion to form handle 28 for carrying the paint box 10. As shown, the outer edges 30 and 32 of handle 28 are folded over to fit comfortably in a persons hand. Between the front end 24 and the back end 26 is a first dropping side section 32 attached to base 12 by means of a hinge 34 and abutting against top 36 which connects the end sections 24 and 26 below handle 28. The dropping side section 32 is secured to the top 36 by means of hook 38, which preferrably is of the swivel type, and strap 40 attached to dropping side section 32. Slit 42 fits over hook 38 and thus secures or locks side 32 to top 36. Second dropping side section in FIG. 1 (not shown) is identical to first dropping side section and will be discussed herein below. Normally in the artist's studio, the paint box 10 as shown may be carefully carried from one place to another place without any of the equipment falling out.

Figure 2:
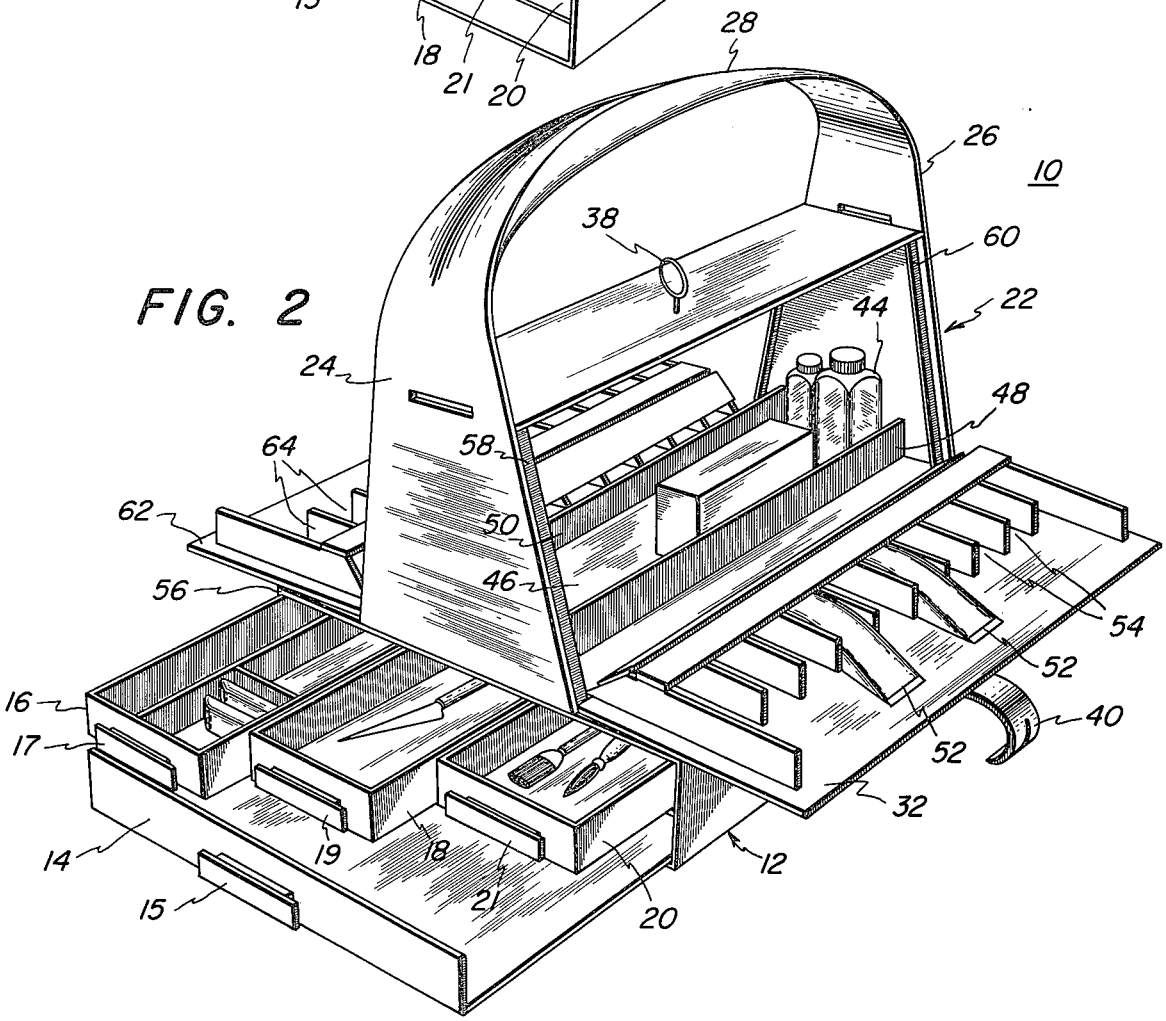
FIG. 2 is a three dimensional view of the paint box of FIG. 1 showing the open paint box with artists materials revealed therein.

In FIG. 2, wherein like parts are designated by the same numerals, the paint box 10 is shown open with some typical artist's equipment stored inside, but it is intentionally not fully stocked in order to illustrate the detail of the interior of the paint box 10. Drawers 14, 16, 18 and 20 are slidably inserted in the base 12 and have been partially pulled out to expose the contents. The bottom drawer 14 is used for storing the palette and requires no sides. The smaller drawers 16, 18 and 20 are used for storing artist's equipment such as brushes, spatulas, charcoal, erasers, rulers and the like.

The main storage space for tubes of oil paints and containers for solvents, paint mediums and the like is in the upper section or body 22. The front end section 24 and the back end section 26 together with the handle 28 are preferrably molded having a unitary structure from a single sheet of plastic material as shown, although each end section 24 and 26 and the handle 28 may be fabricated from separate parts which are subsequently attached to each other. The solvents and liquids in containers 44 are stored upright in storage space 46 which is bounded by rigid strips 48 and 50 to restrict movement of containers 44. The interior of first dropping side section 32 is adapted to store tubes 52 of oil paint in a first plurality of individual secure compartments 54. This permits the artist to fully organize his paint tubes 52 so that he knows exactly where to look for a particular color and when they have to be replaced. In the open position, the first dropping side section 32 rests on top 56 of base 12. There are two sections of molding 58 and 60 set back along the inside of front end 24 and back end 26 respectively, and when first dropping side section 32 is raised to close paint box 10, section 32 leans or rests against molding 58 and 60. On the opposing side of paint box 10 is second dropping side section 62 having a second plurality of compartments 64 and which is substantially identical to the first dropping side section 32 in structure and operation.

The novel paint box 10 of my invention can be placed on a cart in the artist's studio using the wheels of the cart to move it from one place to another.

In another embodiment of my invention, a securing means 66 as illustrated in FIG. 3 should be used for maintaining the paint box 10 closed and for keeping the drawers from falling out while the paint box 10 is being carried from place to place from the artist's studio to, for example, an outdoor location. Securing means 66 is preferrably made from heavy cloth material which has sufficient strength and durability for extended use. The exact shape of this securing means 66 may vary to some extent but should conform substantially to the shape of the paint box 10.

The front portion 68 of the securing means 66 has openings 70, 72, 74 and 76 for handles 15, 17, 19 and 21 to pass through. At the end of front portion 68 is a front strap 78 with a front strap slit 80. At the end of back portion 82 of the securing means 66 is also a back strap 84 with a back strap slit 86.

As shown in FIG. 4, securing means 66 is placed around the bottom of base 12 in such a manner that handles 15, 17, 19 and 21 pass through holes 70, 72, 74 and 76 respectively. Securing means 66 then is placed along front end 24 with front strap 78 passing through first strap opening 88 in such a manner that hook 38 passes through front strap slit 80. The back portion 82 of securing means 66 is similarly placed along back end 26 with back strap 84 passing through second strap opening 90 also in such a manner that hook 38 passes through back strap slit 86. Hook 38 also passes through side strap slit 42 of strap 40 and side strap slit (not shown) of strap 92. Optionally, if desired, a small padlock may be passed through opening 94 in hook 38.

The novel paint box can be made from conventional light weight, solvent resistant materials. Preferrably moldable plastics are used, such as for example polymethylmethacrylate commercially available under the trademark Lucite from DuPont and polycarbonate commercially available under the trademark Lexan from General Electric.

While this invention has been disclosed with respect to particular embodiments thereof, numerous modifications may be made by those skilled in the art without departing from its true spirit and scope. Therefore, it is intended that the appended claims cover all such modifications and variations which come within the true spirit and scope of the present invention.

What is claimed as new and desired to be secured by Letters Patent of the United States is:

1. A paint box for storing and transporting artist's materials, said paint box comprising a base storage section having an upper flat surface and having a plurality of drawers slidably arranged to open at one end, a main body storage section mounted on said base and comprising a front end located on the same side as said one end, a back end opposite said front end, a top connected between said front end and said back end, a first dropping side attached by a hinging means to said base on one side of said body and spaced inwardly from one side of said base to permit said first side to rest flat upon said base or to stand substantially upright enclosing a first opening bounded by said front end, said top and said back end, and a second dropping side attached by a hinging means to said base on the side opposite to said one side and spaced inwardly from the side opposite said one side of said base to permit said second side to rest flat upon said base or to stand substantially upright enclosing a second opening, opposite said first opening, bounded by said front end, said top and said back end.

2. The paint box of claim 1, wherein said base contains a large drawer sealed with a gasket for storing a palette.

3. The paint box of claim 1, additionally comprising a handle connecting said front end and said back end and located above the top of said main body storage section.

4. The paint box of claim 1, wherein the interior section of said first dropping side is provided with a first plurality of individual compartments and the interior section of said second dropping side is provided with a second plurality of individual compartments, said compartments being adapted to store tubes of oil paints.

5. The paint box of claim 4, wherein the main body storage section is provided with a space for storing containers of liquid in the upright position.

6. The paint box of claim 3, additionally comprising means for maintaining said paint box closed.

7. The paint box of claim 6, wherein said means includes a hook attached to said top of said main body storage section, a first strap attached at one end of said first dropping side and having a slit near the other end thereof, a second strap attached at one end to said second dropping side and having a slit near the other end thereof, whereby when said paint box is in the closed position said hook passes through said slit of said first strap and said slit of said second strap.

8. The paint box of claim 6, wherein said drawers have outwardly projecting drawer pulls. Pg,12

9. The paint box of claim 8, wherein said means for maintaining said paint box closed includes an external securing means of a strong cloth material shaped to conform to the shape of the paint box from front to rear and having a plurality of holes for said pulls therein, a front strap with a slit near the end thereof and a back strap with another slit near the end thereof, such that the securing means is placed around the bottom of the base storage section with the drawer pulls extending through said holes, the front end of said securing means is placed along the front end of said main body storage section having a front strap opening therein, in such a manner that the front strap is passed through said front strap opening, and said hook passes through said slit in said front strap, and the back end of said securing means is placed along the back end of said main body storage section having a back strap opening therein, in such a manner that the back strap is passed through said back strap opening and said hook passes through said slit in said back strap.

10. The paint box of claim 1, wherein said box is formed from a plastic material selected from the group consisting of polymethylmethacrylate and polycarbonate.

* * * * *